United States Patent [19]

Work

[11] 4,045,895

[45] Sept. 6, 1977

[54] DISPLAY SIGN

[75] Inventor: Gerald L. Work, Spokane, Wash.

[73] Assignee: American Sign and Indicator Corporation, Spokane, Wash.

[21] Appl. No.: 708,913

[22] Filed: July 26, 1976

[51] Int. Cl.[2] ..... G09F 11/34

[52] U.S. Cl. ..... 40/28 C; 340/366 E; 340/378 R

[58] Field of Search ..... 40/28 C, 52 R, 65, 28 R; 340/378 R, 373, 366 E, 366 B, 378 A

[56] References Cited

U.S. PATENT DOCUMENTS

| | | | |
|---|---|---|---|
| 3,562,938 | 2/1971 | Salam | 40/28 C |
| 3,601,914 | 8/1971 | Fuller | 40/28 C |
| 3,659,366 | 5/1972 | Woolfolk | 40/28 C |
| 3,685,040 | 8/1972 | Hart | 40/28 C X |
| 3,827,168 | 8/1974 | Mori | 40/110 |
| 3,995,386 | 12/1976 | Salam | 40/28 C |

FOREIGN PATENT DOCUMENTS

| | | | |
|---|---|---|---|
| 1,414,460 | 11/1975 | United Kingdom | 40/28 C |

*Primary Examiner*—John F. Pitrelli
*Attorney, Agent, or Firm*—Wells, St. John & Roberts

[57] ABSTRACT

A display sign of the type comprising a back-lighted panel having a plurality of discrete light-transmitting areas and controlled opaque discs which selectively overlie the individual light-transmitting areas to produce a desired visual pattern of light transmitted through the panel. The improvement comprises discrete projections for supporting the individual discs. The arrangement of projections serves as structural reinforcement in the panel.

3 Claims, 6 Drawing Figures

DISPLAY SIGN

BACKGROUND OF THE INVENTION

This invention relates to information display signs or devices of the general type illustrated in U.S. Pat. No. 3,562,938 to Salam, granted Feb. 16, 1971. Such devices basically comprise a panel having a plurality of discrete light-transmitting areas arranged along transversely spaced upright columns and surrounded by a background which is perferably, but not essentially, opaque. The panel is normally backlighted and the desired display is usually viewed as light transmitted through the discrete areas. Circular discs are mounted behind the panel for planar movement of each disc between a first position overlying a light-transmitting area and a second position clear of such area. By arranging the individual discs in one or the other of such positions, any desired pattern of light transmission can be achieved through the individual light-transmitting areas, thereby producing the desired visual pattern on the viewed panel.

Prior structures pertaining to this type of display have typically utilized multiple layers of material to produce individual retaining cells surrounding each disc. The laminated struture produced by these layers presents substantial fabrication problems relating to choice of materials, material compatability between the various layers and the discs, surface irregularities produced during stamping of various layers, and adhesive problems encountered in bonding the various layers to one another. These difficulties become even more pronounced when attempting to fabricate such a display sign for exterior use, where temperature fluctuations, wind loads and structural design elements reach substantial magnitudes.

The present alternative panel structure was devised in an attempt to simplify fabrication, while simultaneously providing structural reinforcement in the panel itself. The improvement further reduces or completely eliminates the need for use of adhesive to produce a sandwiched panel structure.

Other patents relating to this general type of display are U.S. Pats. Nos. 3,685,040, 3,601,914 and 3,659,366. They are illustrative of prior attempts to fabricate this general type of display by laminating successive sheets of materials to one another.

According to this disclosure, the movable discs rest upon discrete projections formed between the panel and a backing member. The projections are arranged along upright columns and transverse lines. The spacing between the projections adjacent to one another in each line is less than the diameter of the discs, so that the discs can rest in a bridging position supported by two adjacent projections. The upright spacing between parallel projections in one column is greater than the disc diameter, while the corresponding upright spacing between projections in the laterally adjacent columns is less than the diameter of the discs. Therefore, the disc can be moved over the projection on which it rests in the one column, but cannot pass between the projections in the adjacent columns. Each disc is therefore accurately supported in two stable positions and is restricted in its movement to assure its proper position either overlying a light-transmitting area of the panel, or clear of such area.

SUMMARY OF THE INVENTION

The invention relates to information display devices having an upright panel with a plurality of discrete light-transmitting areas arranged along transversely spaced upright columns and surrounded by a background. A backing member is spaced parallel to the panel. A plurality of circular discs equal in number to the number of light-transmitting areas on the panel are located between the panel and the backing member. Each disc has a diameter capable of overlying a light-transmitting area and is movable between a first position overlying such area and a second position clear of it.

The present improvement comprises projections in the path of movement of the discs arranged in parallel upright columns along a corresponding first side of each light-transmitting area, including discrete projections on which the individual discs rest while at their alternate positions and over which each disc must move when shifted between its alternate positions. Second projections are spaced transversely from the first projections and located in the path of movement of the disc in parallel columns flanking the first projections at each side thereof for resting engagement by a disc while at its alternate positions. The first and second projections in adjacent columns are spaced transversely by a distance less than the disc diameter.

It is a first object of this invention to provide an improved panel structure and support for the movable discs which can be fabricated from two layers while presenting a fully enclosed panel structure.

Another object of the invention is to provide an improved panel structure in which the supporting projections for the discs serve as structural reinforcement for the respective panel layers.

These and further objects will be evident from the following disclosure and the illustrative embodiments shown in the drawings.

DESCRIPTION OF THE PREFERRED EMBODIMENTS

Figure 1:
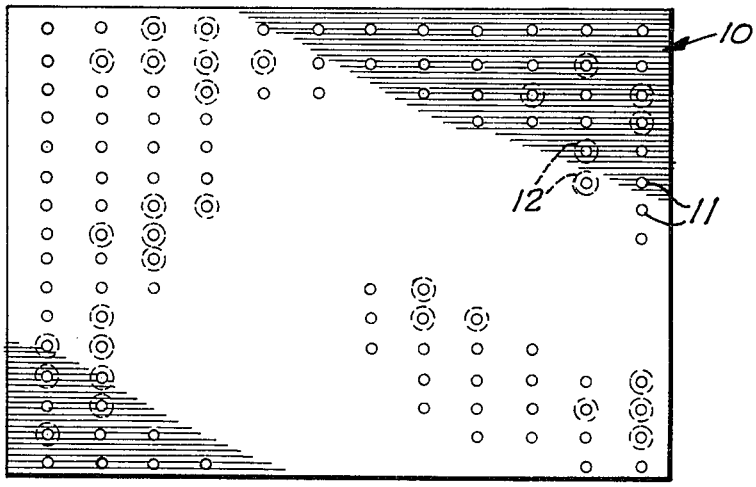
FIG. 1 is a schematic elevational view of a typical panel display.

As shown in FIG. 1, this disclosure relates to a display sign comprising an upright back-lighted panel 10 having a plurality of discrete light-transmitting areas 11 arranged along transversely spaced upright columns and intersecting transverse lines. While the drawings illustrate the columns as being vertical and the lines as being horizontal, this is not a necessary limitation to the application of the disclosure, since they might be arranged along oblique rows forming angles to either the vertical or horizontal or both. Similarly, while the panel 10 is normally arranged for display in a vertical position, it can be arranged in other upright positions oblique to the vertical when desired.

Immediately rearward of the panel 10 are located a plurality of circular discs individually movable between positions overlying the light-transmitting areas and clear of such area. These discs 12 are mounted loosely behind panel 10 and are shifted between their alternate positions by noncontacting means (not shown). Discs 12 are normally opaque. Examples of magnetic devices for moving the discs are described in U.S. Pat. No. 3,562,938 to Salam, which is hereby incorporated by reference. Other noncontacting means for applying force to the discs 12 can be utilized, such as electrostatic force applying devices. The precise means by which the discs are shifted to produce the desired visual display in conjunction with the light-transmitting areas 11 does not form a part of the present disclosure except as a general understanding of such movement is necessary to comprehend the development and application of this disclosure.

Figure 2:
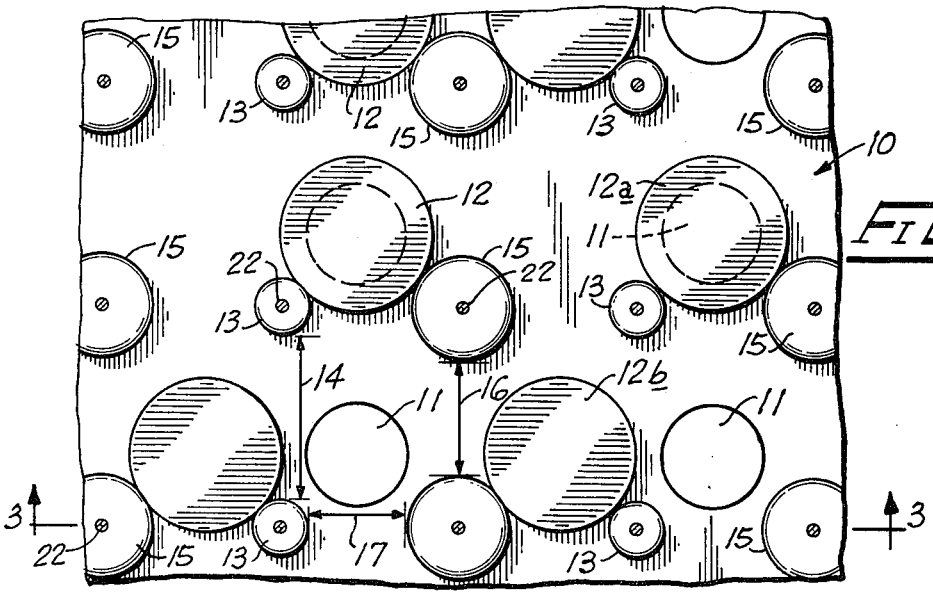
FIG. 2 is an enlarged schematic elevational view showing the discs and projections with the panel.

FIG. 2 diagrammatically illlustrates the essential relationship of the panel structure as it interrelates to discs 12. Each disc 12 is moved in a planar fashion from a first position (illustrated by disc 12*a*) wherein it overlies a light-transmitting area 11 in the panel 10 to a second position (illustrated by disc 12*b*) where it is clear of the light-transmitting area 11 and is behind the background area about panel 10.

A first projection means is located in the path of movement of each disc 12 and is arranged in parallel upright columns along a corresponding first side of each light-transmitting area 11. The first projection means includes discrete projections 13 on which the individual disc 13 rest while at their first and second positions. Each disc 12 must move over one projection 13 when being shifted between its first and second positions as shown in FIG. 2.

The discrete projections 13 are illustrated as cylindrical posts, although they can be fashioned in other geometric shapes. Normally the upwardly facing surfaces across the top of each projection 13 will be arcuate so as to facilitate rolling movement of disc 12 as it moves over this obstruction to its lateral movement. The projections 13 are arranged in upright columns which will normally be vertical, although this is not an essential relationship.

The upright spacing between adjacent projections 13 in each column is greater than the diameter of the individual discs 12. This spacing is indicated in FIG. 2 by the numeral 14. Thus, each disc 12 can pass laterally or transversely between the vertically adjacent projections 13 that comprise the first projection means within the panel.

Second projection means is provided within the panel in the path of movement of each disc 12 and is spaced transversely apart from the first projection means just described. The second projection means is illustrated as individual posts 15. The posts 15 are also arranged in parallel columns and flank the posts 13 which comprise the first projection means. The parallel upright columns presented by posts 15 are arranged at each side of an upright column comprised of posts 13. Posts 15 are also provided for resting engagement by a disc 12 while at its first and second position respectively, depending on which side of post 13 and individual disc 12 is located for a particular display purpose.

The upright spacing between adjacent posts or projections 15 in the columns comprising the second projection means is less than the diameter of an individual disc 12. This upright spacing is indicated in FIG. 2 by the numeral 16. Therefore, the disc 13 is unable to pass laterally or transversely between adjacent projections 15. If desired for structural reasons, the projections 15 can be continuous along each file, rather than being formed as discrete posts.

The columns containing the projections 13 and 15 are transversely spaced apart by a distance less than the diameter of an individual disc 12. This distance or spacing is illustrated in FIG. 2 by the reference numeral 17. This restricted transverse spacing between the projections or posts 13, 15 prevents the individual discs 12 from passing between the projections in adjacent columns. Each disc is therefore maintained in one of two bi-stable positions at one side or the other of a column containing the posts 13, which intersect the operational area of movement of each disc 12.

As can be seen in FIG. 2, this boundary arrangement of posts provides stable resting engagement for each disc in each of its two alternate positions. In order to move disc 13 from one position to the other, a positive force must be applied to the disc, which is applied by noncontacting means. Each disc is bounded individually and the areas of contact between the discs and the bounding members is minimized. This is particularly advantageous so as to minimize the operational difficulty possible due to fabrication inconsistencies, loose dust particles, or other foreign substances that might become entrapped between the laminations of the display structure. In contrast to the use of an enclosed cell to surround each disc 12, this open construction allows the discs 12 to clear themselves from foreign particles. The ability of disc 12 to work free from interference by foreign particles is most important, since even one malfunctioning disc 12 in a back-lighted display can be detrimental to the desired visual effect.

Figure 3:
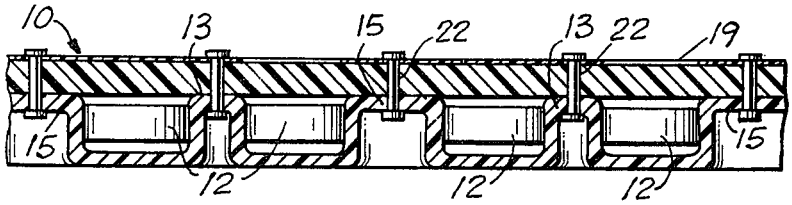
FIG. 3 is an enlarged sectional view seen along line 3—3 in FIG. 2.
Figure 4:
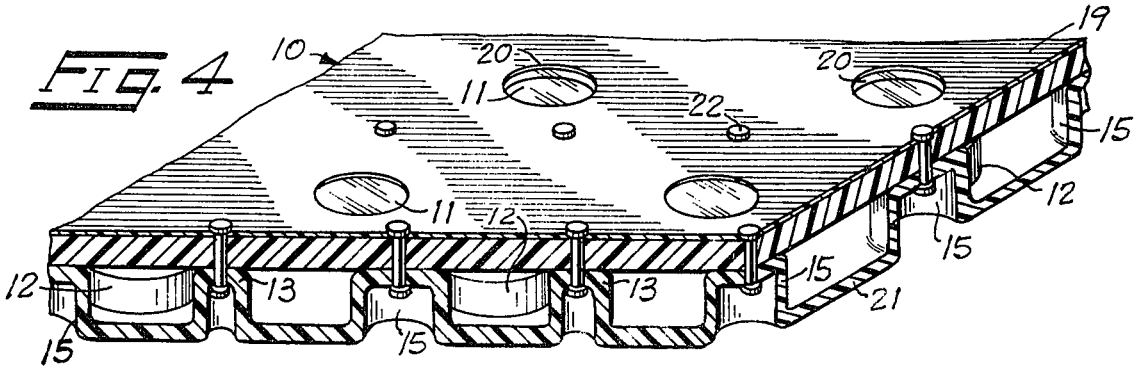
FIG. 4 is an enlarged perspective view of the panel.

FIGS. 3 through 6 illustrate cross sections showing structural arrangements incorporating this invention. In FIGS. 3 and 4, the panel 10 is formed from planar opaque material, and has a series of open apertures 20 formed through it. Each aperture 20 comprises a single light-transmitting area as discussed above. A backing member 21 immediately rearward of panel 10 is preferably molded from sheet material in such fashion as to present integral projections 13 and 15 along upright columns. The projections 13, 15 alternate across the transverse lines presented on the backing member 21. The discs 12 are bounded by the projections 13, 15 in the manner discussed with respect to FIG. 2. Each projection 13, 15 is secured to the back surface of panel 10, preferably by adhesive. Where desired, the posts 13 or posts 15, or both, can also be mechanically secured by pins or rivets illustrated generally at 22. If desired, such mechanical connection can be used in place of adhesives, which has the benefit of eliminating disc engagement by surplus adhesive that might seep outward from the boundaries of the projections 13, 15. Such mechanical connections are also very useful in outdoor applications, since they would provide substantial structural reinforcement to the fabricated sheet structure.

FIGS. 2 and 4 simply show the basic structure using a planar panel 10. Since it is normally desired that the display be sealed to maintain the area of movement about the disc 12 in a clean condition, the use of open apertures 20 normally requires an overlaying transparent sheet of plastic or glass 19.

Figure 5:
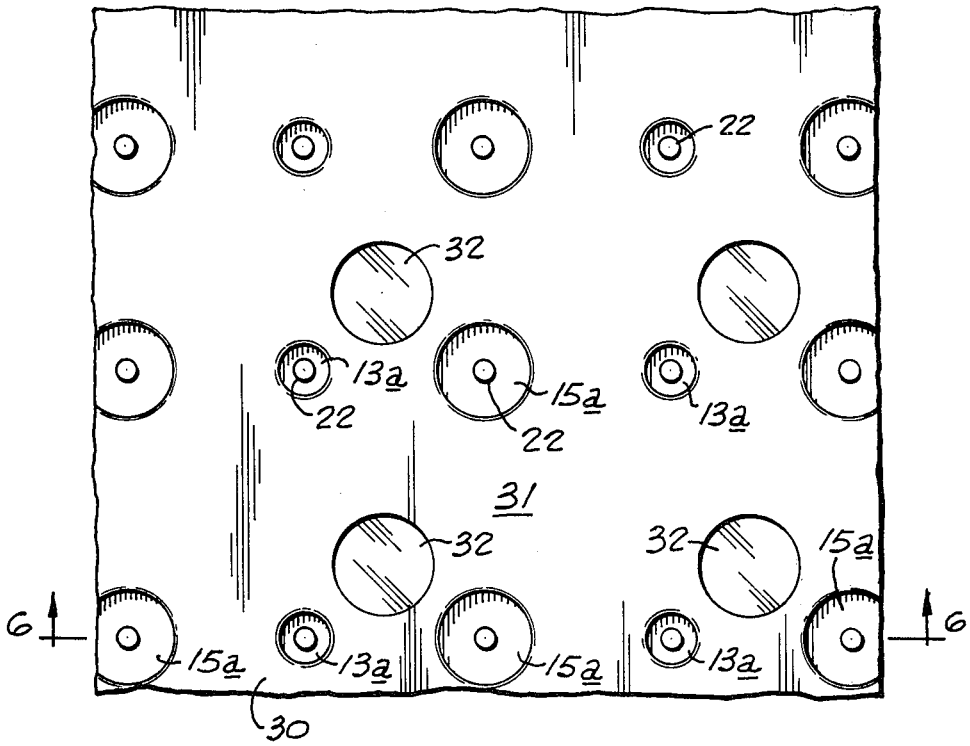
FIG. 5 is an elevational view of a second embodiment.
Figure 6:
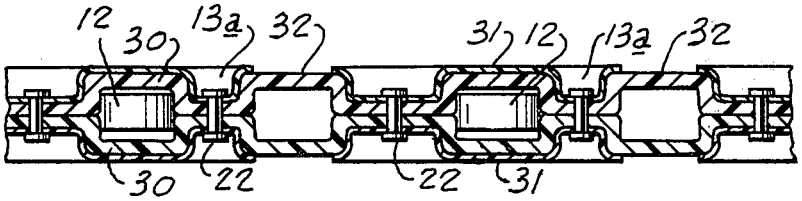
FIG. 6 is a sectional view taken along line 6—6 in FIG. 5.

FIGS. 5 and 6 schematically illustrate a variation in the structure. In this case, two identical molded sheets of plastic resin or other suitable material are illustrated generally be reference numeral 30. The two sheets of material 30 are joined back to back by mechanical pins or rivets 22 at the center of projections 13*a* and 15*a*, which correspond to the projections 13, 15 illustrated in FIG. 2. Projections 13*a* and 15*a* are integrally molded in the sheets 30 and each projection extends one half the desired height of the complete projection structure. In this form, the sheets 30 are illustrated as being formed from transparent or transluscent material, with an opaque coating 31 being applied to both sheet surfaces to define uncoated light-transmitting areas 32. The background about the display is indicated by the opaque coated areas. This arrangement provides a completely sealed display when the periphery about the panel is fully enclosed, and has the added cost advantage of using identical sheet structures for both the front panel and backing member. It provides an effective manner for producing the display sign from a minimum of two laminated layers of identical structure.

The above described embodiments are only generally descriptive of the present invention in this type of display sign. Variations are possible in the choice of materials and in the light-transmitting properties of both the light-transmitting areas 11 and the background areas surrounding them. The disclosure is concerned primarily with the arrangement of the projections that bound the areas of movement of the individual discs 12 and which provide a simple structural boundary for the bi-stable movement afforded each disc 12. The scope of the claimed improvements are described in the following claims.

Having thus described my invention, I claim:

1. In an information display device having:

an upright panel with a plurality of discrete light-transmitting areas arranged along transversely spaced upright columns and surrounded by a background;

a backing member spaced parallel to the panel;

and a plurality of circular discs equal in number to the number of light-transmitting areas on the panel, each disc having a diameter capable of overlying a light-transmitting area and a thickness less than the spacing between the panel and backing member, the diameter of each disc being greater than said spacing;

each disc being located between the panel and backing member for planar movement between a first position overlying a light-transmitting area and a second position clear of such area;

the improvement comprising:

first projection means located in the path of movement of the discs between the panel and backing member and arranged in columns located at a corresponding first side of each light-transmitting area, said first projection means including discrete projections on which the individual discs rest while at their first and second positions, and over which each disc must move when being shifted between its first and second position; and second projection means spaced transversely apart from said first projection means and located in the path of movement of the discs between the panel and backing member and arranged in parallel columns flanking the first projection means at each side thereof for resting engagement by a disc while at its first or second position respectively;

said first and second projection means in adjacent columns being spaced transversely by a distance less than the disc diameter.

2. In an information display device having:

an upright panel having a plurality of discrete light-transmitting areas arranged along upright parallel columns alternating across the panel with light blocking areas arranged along upright parallel columns, wherein the light-transmitting and light-blocking areas are paired in side-by-side relation to one another;

a backing member spaced parallel to the panel;

and a plurality of circular discs equal in number to the number of light-transmitting areas on the panel, each disc having a diameter capable of overlying a light-transmitting area and a thickness less than the spacing between the panel and backing member, the diameter of each disc being greater than said spacing;

each disc being located between the panel and backing member for planar movement between alternate positions overlying a light-transmitting area or overlying a light-blocking area;

the improvement comprising:

first projection means arranged in parallel upright columns intersecting each pair of light-transmitting and light-blocking areas said first projection means having discrete projections positioned between the panel and backing member individually located at the lower center position between each paired light-transmitting and light-blocking area for vertically supporting the disc while in either of its alternate positions;

second projection means spaced transversely apart from said first projection means and arranged in parallel upright columns at the respective transverse sides of the paired light-transmitting and light-blocking areas of the panel, said second projection means being positioned between the panel and backing member for limiting transverse movement of the discs;

said first and second projection means in adjacent columns being spaced apart transversely by a distance less than the diameter of a disc.

3. An information display device comprising:

an upright panel having a two dimensional pattern of transversely spaced light-transmitting area surrounded by a background;

a backing member spaced parallel to the panel;

a plurality of circular discs equal in number to the number of light-transmitting areas on the panel;

and a plurality of discrete fixed projections located between the panel and backing member said projections being arranged in transverse lines and upright columns;

the transverse spacing between the projections in each being a distance less than the diameter of the discs to thereby prevent elevational passage of a disc between adjacent projections;

the location of each light-transmitting area on the panel being surrounded by four adjacent projections in two adjacent lines and two adjacent columns;

the upright spacing between the projections in a column along a corresponding first side of the light-transmitting areas being a distance greater than the diameter of the discs to thereby permit passage of a disc between them;

the upright spacing between the projections in columns along the corresponding remaining side of the light-transmitting areas being a distance less than the diameter of a disc to thereby prevent passage of a disc between them;

each disc being located between the upright panel and backing member for planar movement of the disc between a first position bounded by the surrounding projections in two column at the respective sides of a light-transmitting area and a second position wherein it is bounded by projections in the column along said first side of the light-transmitting area and by projections in a column outwardly adjacent to said first side of the light-transmitting area.

* * * * *